US006060110A

United States Patent [19]

Wozny

[11] Patent Number: 6,060,110

[45] Date of Patent: May 9, 2000

[54] PROCESS AND APPARATUS FOR ADJUSTMENT OF AN ELONGATED COMPONENT PART WHICH EXTENDS ACROSS THE WIDTH OF A MOVING MATERIAL WEB

[75] Inventor: Eckard Wozny, Heidenheim, Germany

[73] Assignee: Voith Sulzer Papiertechnik GmbH, Heidenheim, Germany

[21] Appl. No.: 09/193,611

[22] Filed: Nov. 17, 1998

[30] Foreign Application Priority Data

Nov. 18, 1997 [DE] Germany ..... 197 51 098

[51] Int. Cl.[7] ..... B05D 1/42; B05C 11/04

[52] U.S. Cl. ..... 427/8; 427/356; 118/712; 118/123; 118/126; 118/410; 118/413

[58] Field of Search ..... 118/126, 712, 118/413, 410, 123; 427/8, 356

[56] References Cited

U.S. PATENT DOCUMENTS

| | | | |
|---|---|---|---|
| 4,907,528 | 3/1990 | Sollinger | 118/121 |
| 5,221,351 | 6/1993 | Esser et al. | 118/712 |
| 5,453,128 | 9/1995 | Kustermann et al. | 118/126 |
| 5,472,504 | 12/1995 | Kustermann et al. | 118/126 |
| 5,556,467 | 9/1996 | Koskinen et al. | 118/126 |

FOREIGN PATENT DOCUMENTS

| | | |
|---|---|---|
| 0 536 649 B1 | 8/1995 | European Pat. Off. . |
| 0 781 608 A2 | 7/1997 | European Pat. Off. . |
| 41 41 214 A1 | 6/1992 | Germany . |
| 41 41 217 A1 | 6/1992 | Germany . |
| 41 16 729 A1 | 11/1992 | Germany . |

*Primary Examiner*—Katherine A. Bareford
*Attorney, Agent, or Firm*—Taylor & Aust, P.C.

[57] ABSTRACT

An elongated component part, extending across the width of a moving material web, can be adjusted for the purpose of applying a liquid or viscid medium onto the moving material web. The component part is supported by a supporting beam and is equipped with an adjustment fixture including a plurality of adjustment devices which are arranged along the length of the elongated component part at the support locations. The adjustment devices are separated from each other and adjusted for achieving a forced deformation of the component part in a direction that is perpendicular to their longitudinal axis. The adjustment positions of the respective adjustment devices are recorded. Imaginary connecting lines between the free ends of two respective, neighboring support locations are formed. An angle between two respective, neighboring connecting lines is calculated. The respective, calculated angle is compared with a pre-determined boundary angle. Either the respective adjustment device is adjusted by a pre-determined adjustment distance until the desired angle is achieved, or the adjustment of the respective adjustment device is terminated in case the pre-determined boundary angle is reached.

6 Claims, 4 Drawing Sheets

PROCESS AND APPARATUS FOR ADJUSTMENT OF AN ELONGATED COMPONENT PART WHICH EXTENDS ACROSS THE WIDTH OF A MOVING MATERIAL WEB

BACKGROUND OF THE INVENTION

1. Field of the Invention

The present invention relates to a process for adjusting an elongated component part, extending across the width of a moving material web, for the purpose of applying a liquid or viscid medium onto the moving material web. Further, this invention relates to an apparatus to adjust such a component part.

2. Description of the Related Art

Processes and apparatuses for adjusting an elongated component part extending across a moving material web are being applied within the scope of so-called coating systems. Such coating systems coat a moving material web made of, for example, paper, carton or a textile material, either on one side or both sides with one or more layers of liquid or viscid coating medium such as, for example, coloring substance, starch, impregnating fluid, or the like.

In a so-called direct application, the liquid or viscid medium is applied by a coating mechanism directly onto the surface of the moving material web which, during the application process, is carried on a rotating support surface such as, for example, a continuous loop belt or a backing roll.

In an indirect application of the medium, the liquid or viscid medium is, on the other hand, first applied onto a supporting surface serving as a counter surface such as, for example, a mating roll designed as an applicator roll. From there, the coating medium is carried into the nip (roll split) through which the material web runs, resulting in the transfer of the medium from the applicator roll onto the material web.

Such apparatuses usually include an elongated component part, extending across the width of a moving material web, which is supported by a supporting beam as well as an adjustment fixture which is attached to the supporting beam. The adjustment fixture includes a plurality of adjustment devices which are distributed along the width of the component part and which are adjusted directionally perpendicular to their longitudinal axis to locally different setting ranges for the purpose of achieving a forced deformation of the component part.

This elongated component part can, for example, be the load rail for the profiling of a doctor element or the slice bar of the headbox of a paper-making machine.

For the purpose of profiling the elongated component part, the individual adjustment devices, i.e., the adjusting spindles, are individually adjusted. Typically, a maximum allowable adjustment range is specified whereby the adjustment range for each adjustment device is typically the same. If, during profiling of the rail, each of the adjustment spindles is adjusted to its maximum allowable range, a liner deformation of the rail is achieved. This has the consequence that the neighboring designated partitions of the rail, which is incrementally affected by each adjustment device, are flush in terms of their alignment. The amount of the maximum allowable adjustment is obtained by establishing the difference in adjustment travel between the current and the neighboring adjustment device.

The disadvantage associated with this established process and apparatus is that the maximum amount of deformation of the elongated component part lies substantially under the technical possible deformation.

SUMMARY OF THE INVENTION

The present invention provides a generic process that allows an increase in the adjustment range and a variable conformation of the deformation. The present invention also provides a generic apparatus so that the maximum possible adjustment of the elongated component part is optimized through an increase of the adjustment range.

The forming of imaginary connecting lines between the respective adjustment devices, and the subsequent calculation of the angle between each of the two neighboring connecting lines makes it possible to achieve, by comparing the respective calculated angles with a pre-determined angular limit, an optimum conformation of the adjustment to the individual requirement.

With this process, the actual bending stress of the elongated component unit does not have to be calculated with a complex mathematical computer program, since in lieu of the bending stress, only the relative angle between two imaginary connecting lines needs to be determined. The calculation is therefore made simpler and, correspondingly, the apparatus becomes more cost effective. The calculation is performed, as a practical matter, during the adjustment process on a continuous basis. It can, however, be performed in certain pre-determined time intervals or it can be performed at times when situations arise that warrant a calculation. Additionally, this process, which is the basis for this invention, makes it fundamentally possible to simulate the adjustment of an elongated component unit.

Preferably, the attained elastic line, which is achieved through activation of the adjustment device, should be smoothed to reduce local stress concentrations. This can be accomplished by reducing the local maximum angle and by enlarging the neighboring angle without fundamentally changing the desired forced deformation. The steps can be performed repeatedly in order to iteratively obtain an optimum setting.

The apparatus of the present invention makes it possible to deform the elongated component part substantially more than is possible with known devices since the criteria for the maximum adjustment of two neighboring adjustment devices is given by the maximum bending stress in the elongated component part. This has the consequence that two neighboring partitions of the elongated component part can be positioned relative to each other at an angle that is either larger or smaller than can be realized by the known technique which is limited to 180 degrees. In this way, the maximum adjustment range of the elongated component part not only substantially increases relative to the state of the art, but it also makes it possible to achieve, alternatively, smaller or larger adjustment ranges between neighboring partitions than the state of the art permits.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
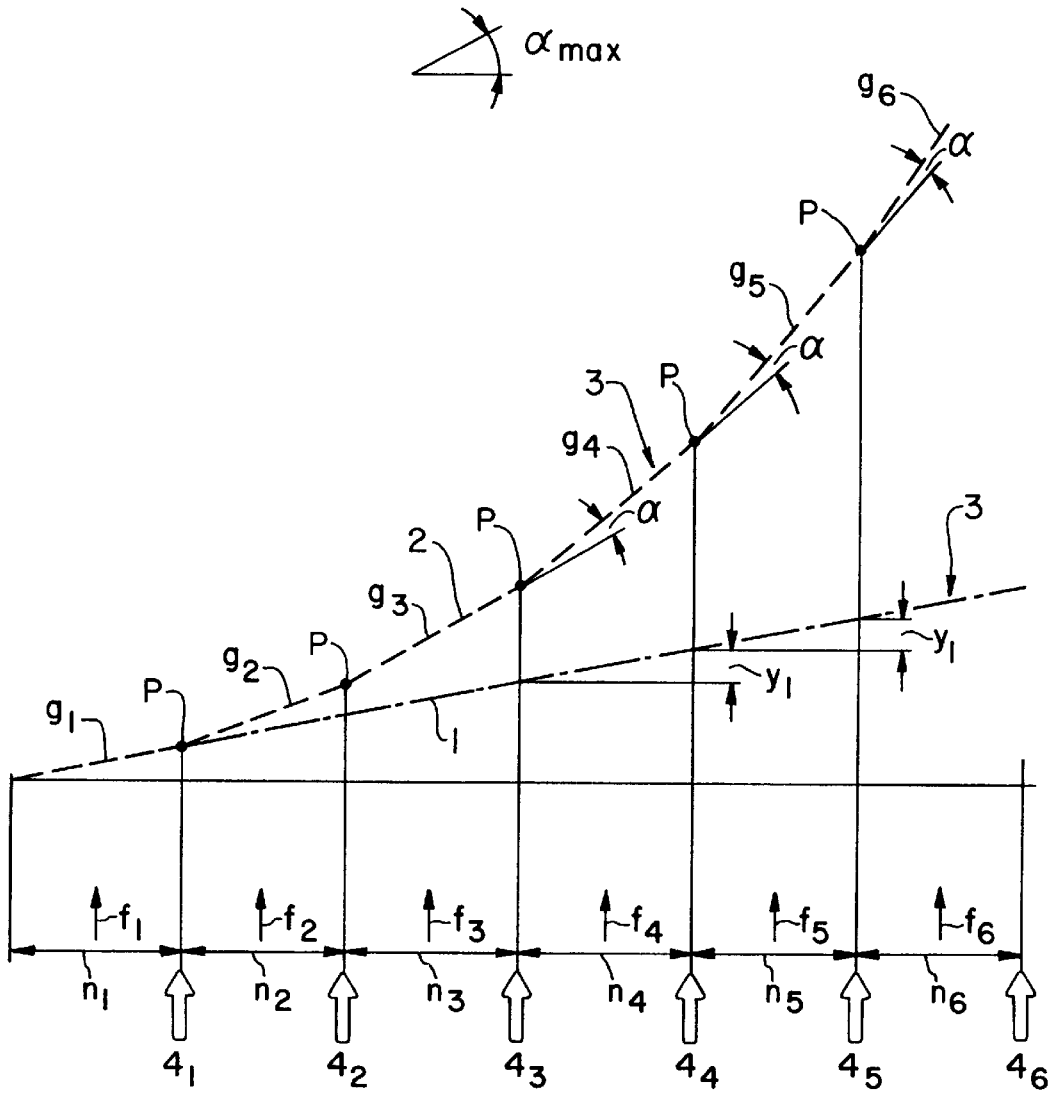
FIG. 1 is a plot of the additional adjustment capability which is obtainable by one embodiment of the apparatus of the present invention compared to a known apparatus.

FIG. 1 graphically depicts two elastic lines 1, 2 of an elongated component part of an apparatus 3. The first elastic line 1 (shown in dot-and dash pattern) reflects the maximum adjustment state of a known apparatus. The second elastic line 2 (dashed line) reflects the curvature that is generated by an apparatus designed in accordance with this invention.

Figure 4:
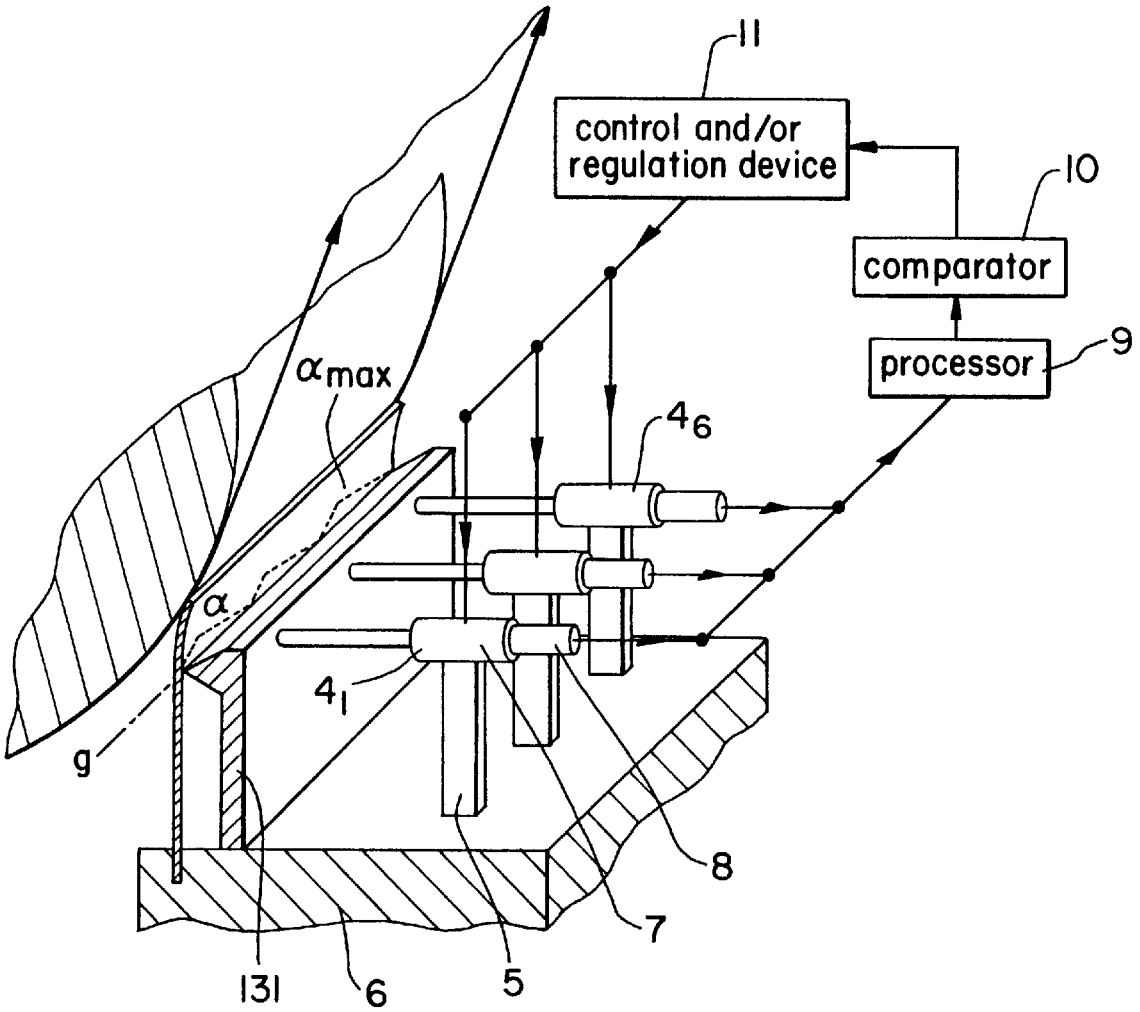
FIG. 4 is a perspective view of one embodiment of the apparatus of the present invention.

The horizontal axis of the graphical depiction in FIG. 1 shows the longitudinal coordinates along the elongated component unit 3, whereby its length is divided into equal length, individual partitions $n_1 \ldots n_6$. Each partition $n_1 \ldots n_6$ is assigned an adjustment device $\mathbf{4}_1 \ldots \mathbf{4}_6$, which, for example, engages at a respective support location 5 (FIG. 4) on the imaginary connection point of the respective partitions $n_1 \ldots n_6$. This results in an application of force onto the elongated component part 3, causing it to move, as indicated by the individual arrows $f_1 \ldots f_6$.

The vertical axis in FIG. 1 shows the amount of excursion of the elongated component part 3 relative to its horizontal initial state depicted in FIG. 1.

The application of a maximum, as well as constant, adjustment for each partition leads to a linear formation of the elastic line 1. This is because the maximum allowable adjustment value $y_1$ is identical for each partition, resulting in a maximum possible total adjustment that is equal to the sum of the individual maximum adjustments of the individual partitions. The following equation applies:

$$\text{maximum total adjustment} = n * y_1$$

wherein $y_1$ is the maximum allowable adjustment of each individual partition, and n is the number of the observed partitions. Elastic line 2, on the other hand, is formed and limited by the adjustment range, having been derived from the maximum bending stress in the elongated component part 3, as described herein. The maximum bending stress is induced by the relative adjustment between two neighboring, imaginary connecting lines. The amount of the maximum adjustment is determined by the angle $\alpha$ which represents the angular relationship between two respective neighboring, imaginary connecting lines $g_1 \ldots g_6$. In the case that is being presented, the imaginary connecting lines $g_1 \ldots g_6$ are generated by connecting the respective neighboring contact points P which are associated with extended or non-extended adjustment devices $\mathbf{4}_1 \ldots \mathbf{4}_6$ which are exerting a force either directly or indirectly upon the component unit 3. Adjustment devices $\mathbf{4}_1 \ldots \mathbf{4}_6$ elastically deform the component unit 3 according to their respective, local excursions. Instead of the points P, other reference points or reference coordinates that lie, for example, directly on component part 3, can be selected to form the imaginary connecting lines $g_1 \ldots g_6$. Although the elastic line 2 of the component part 3 is in reality curve-shaped, it can be reasonably well approximated by the use of the connecting lines $g_1 \ldots g_6$ by selecting appropriately small partitions or small distances between the adjustment devices $\mathbf{4}_1 \ldots \mathbf{4}_6$. For this reason, little or no attempt is made to differentiate between the elastic line 2 of the component part 3 as such and the imaginary connecting lines $g_1 \ldots g_6$ as evidenced by the schematic depiction of FIG. 1. The dashed line between two respective points P also represents the imaginary connecting lines $g_1 \ldots g_6$. To better illustrate the angle $\alpha$, the imaginary connecting lines $g_1 \ldots g_6$ are partially shown as thin solid lines that extend beyond the points P.

The methodology that is described above results in a substantially larger adjustment range without exceeding the elastic deformation domain of the elongated component part. Since the material properties of the elongated component part 3 are substantially homogeneous along its length, the maximum allowable angle $\alpha_{max}$ (depicted schematically in FIG. 1) formed by two neighboring partitions along the length of the elongated component part 3, and as determined, for example, from the material property data, will be the same. The maximum allowable angle $\alpha_{max}$ or the boundary angle $\alpha_{max}$ thus represents a critical (local) bending stress condition of the component part 3 which must not or should not be exceeded.

In order to control the adjustment of the component part 3, the adjustment ranges of the individual adjustment devices $\mathbf{4}_1 \ldots \mathbf{4}_6$ are measured, and, based on these adjustment ranges and the known distances between the adjustment devices $\mathbf{4}_1 \ldots \mathbf{4}_6$, the respective angles a formed between two neighboring imaginary lines $g_1 \ldots g_6$ can be calculated. The calculated, current angles $\alpha$ formed between two neighboring imaginary lines is compared to the maximum allowable angle $\alpha_{max}$ or the predetermined boundary angle in order to determine if the current angle $\alpha$ lies below the limiting values. Depending on the outcome of this comparison, a determination can be made to decide if further tuning, in context with control and/or regulation approaches using a control and/or regulation device, of the adjustment devices is required.

Especially favorable angles $\alpha$ formed between two neighboring imaginary connecting lines $g_1 \ldots g_6$, which have been developed over time, can be stored in a computer storage device and be supplied to the adjustment devices $\mathbf{4}_1 \ldots \mathbf{4}_6$ in form of a pre-set value in order to obtain a specified, desired profile along the length of the elongated component unit 3.

Figure 2:
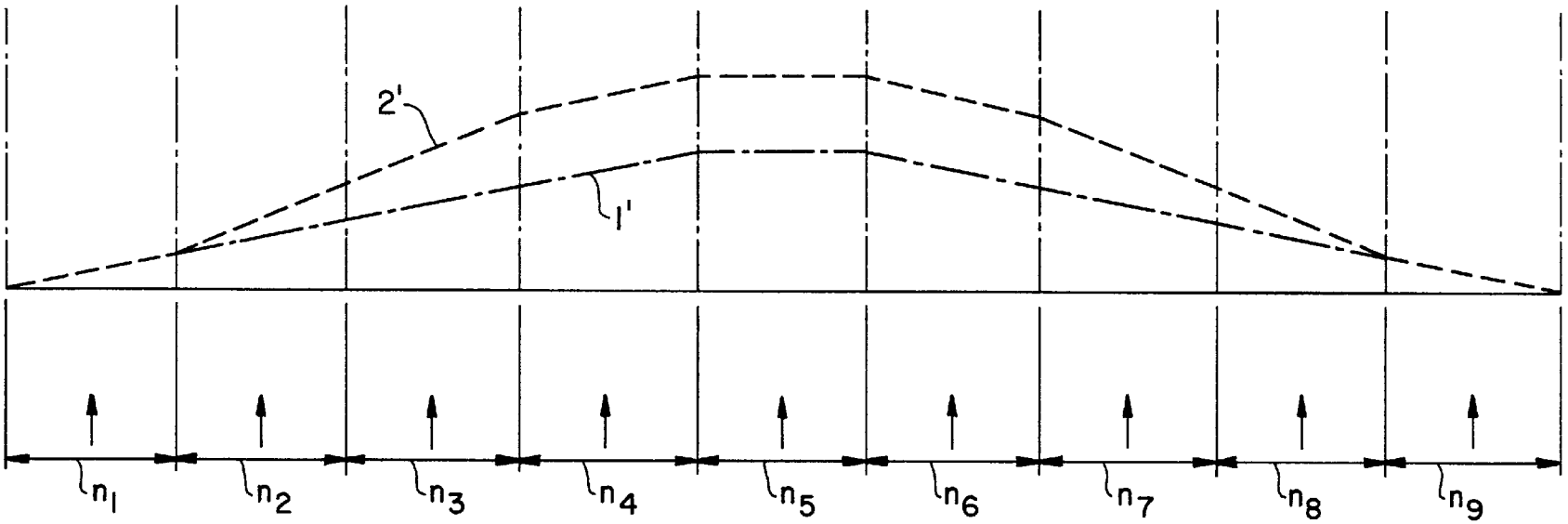
FIG. 2 is a plot of the transverse profile of one embodiment of an adjustable elongated component unit of the present invention compared to a known apparatus.

FIG. 2 shows an example of a graphic illustration of an adjustment profile, depicted as elastic line 2' (shown in dashed line) of a device described herein vis-à-vis a graphic illustration of an adjustment profile, depicted as elastic line 1' (shown in dot-and dash pattern) which reflects the state of the art. The profile in each case is indicated along the length of the elongated component part 3.

By use of this illustration, it is clearly recognizable by the elastic line 2', which is obtained using the process and apparatus of the present invention, that a substantial increase in the amount of profiling together with an increase in adjustment range is possible as compared to the elastic line 1', which reflects the state of the art.

Figures 3A, 3B, 3C, 3D, 3E, 3F, 3G, 3H:
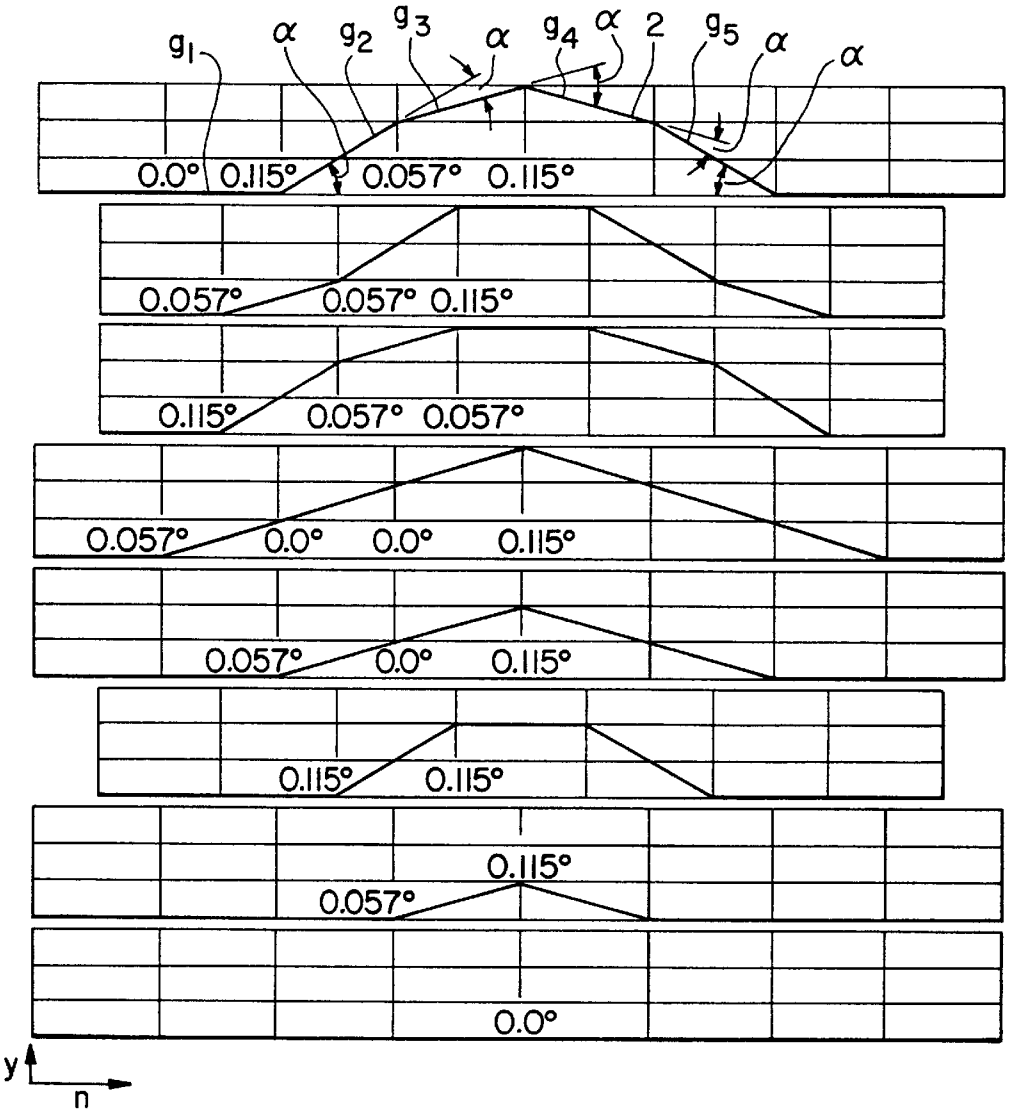
FIG. 3 is a plot of transverse profiles which are adjustable with one embodiment of the apparatus of the present invention.

FIG. 3*a* and 3*h* show possible adjustments of the elastic line represented by the imaginary connecting lines $g_1 \ldots g_6$ which are achievable with the process and apparatus of the present invention. The angles $\alpha$ are shown here as ±0.115 degrees and ±0.057 degrees, respectively. The angle $\alpha$ is the angular relationship between neighboring connecting lines ($g_1 \ldots g_5$). These very small adjustments are within the range observed in actual experience.

Of the illustrated profiles depicted by FIGS. 3*a* through 3*h*, only the profiles shown by 3*d*, 3*e*, 3*g* and 3*h* are realizable by known devices. The remaining profiles are, based on the state of the art, either not permissible or not feasible.

According to the present invention, the profiles shown by FIGS. 3*a*, 3*b*, 3*c* and 3*f* can be obtained without exceeding the maximum loading of the elongated component part 3.

A support beam 6 can be used to support the elongated component part 3. An adjustment fixture, including a plurality of adjustment devices 7 disposed along the length of component part 3 at respective support locations 5, is mounted on support beam 6. Adjustment devices 7 are adjusted for achieving a forced deformation of component part 3 in a direction substantially perpendicular to a longitudinal axis of adjustment devices 7.

A recording device 8 continuously records respective adjustment distances of adjustment devices 7. A processor 9 uses the adjustment distances recorded by recording device 8 to continuously calculate respective angles defined by two adjacent connecting lines of two respective, adjacent support locations 5. A comparator circuit 10 compares the angles calculated by processor 9 to a predetermined angle. A control and/or regulation device 11 controls or regulates adjustment devices 7 in response to a signal from comparator circuit 10.

This invention is not limited to the application example described above, which solely serves to elaborate the main idea of this invention. In context with the protection of this invention, the apparatus, as it is described above, can also assume other design variations. The apparatus can, hereby, include particular features which represent a combination of respective individual features. In accordance to this invention, the elongated component part can, accordingly, serve as the load rail for the profiling of a doctor element (i.e. doctor rod, coater rod, blade or rail) or the panel of the material winding drum of a paper-making machine.

Reference symbols used in the descriptions and drawings serve solely for better explanation of this invention and should not restrict the protection of the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of adjusting a load rail for profiling a doctor element for applying a coating medium onto a moving material web having a width, said method comprising the steps of:

applying the coating medium to the web;

extending the load rail substantially across the width of the web;

supporting the load rail with a support beam;

equipping the load rail with an adjustment fixture including a plurality of adjustment devices disposed along a length of the load rail at a plurality of support locations, said adjustment devices being separated from each other;

adjusting said adjustment devices to achieve a forced deformation of the load rail in a direction substantially perpendicular to a longitudinal axis of said adjustment devices;

recording adjustment positions of respective said adjustment devices;

defining a plurality of connecting lines, each of said connecting lines being between free ends of two respective, adjacent said support locations;

calculating an angle between two respective, adjacent said connecting lines;

comparing said respective calculated angle with a predetermined boundary angle, said predetermined boundary angle being an angle between said two respective, adjacent connecting lines at which a critical bending stress is imposed upon the load rail; and adjusting a respective said adjustment device by a predetermined adjustment distance until one of a desired angle and said predetermined boundary angle is reached.

2. The method of claim 1, comprising the further steps of:

tuning said adjustment devices of the load rail to obtain an elastic line defined by said plurality of connecting lines; and smoothing said elastic line to reduce local stress concentrations by adjusting at least one said adjusting device to thereby reduce a local, maximum angle and enlarge an adjacent angle such that said forced deformation remains substantially constant.

3. The method of claim 2, comprising the further step of continuously repeating all said steps.

4. The method of claim 2, comprising the further step of continuously repeating said steps of tuning said adjustment devices of the load rail to obtain an elastic line defined by said plurality of connecting lines; and smoothing said elastic line to reduce local stress concentrations by adjusting at least one said adjusting device to thereby reduce a local, maximum angle and enlarge an adjacent angle such that said forced deformation remains substantially constant.

5. The method of claim 1, comprising the further steps of continuously repeating said steps of claim 1, and tuning said adjustment devices of the load rail to obtain an elastic line defined by said plurality of connecting lines; and smoothing said elastic line to reduce local stress concentrations by adjusting at least one said adjusting device to thereby reduce a local, maximum angle and enlarge an adjacent angle such that said forced deformation remains substantially constant.

6. A paper-making machine for applying a coating medium onto a moving fiber material web having a width, said paper-making machine comprising:

an applicator configured for applying the coating medium onto the fiber web;

a load rail for profiling a doctor element disposed after said applicator relative to a direction of movement of the fiber web, said load rail having a length extending substantially across the width of the fiber web;

a support beam supporting said load rail; and an apparatus mounted on said support beam and configured for adjusting said load rail, said apparatus including:

an adjustment fixture mounted on said support beam, said adjustment fixture having a plurality of adjustment devices disposed along said length of said load rail at respective support locations, each said adjustment device having a respective contact point at which said adjustment device at least indirectly engages said load rail, pairs of adjacent said contact points each defining a respective connecting line between said adjacent contact points of said pair, said adjustment devices being adjusted for achieving a forced deformation of said load rail in a direction substantially perpendicular to said length of said load rail part;

a recording device configured for continuously recording respective adjustment distances of said adjustment devices;

a processor configured for using said adjustment distances recorded by said recording device to continuously calculate respective angles defined by two adjacent said connecting lines of at least two respective, adjacent said support locations;

a comparator circuit configured for comparing said angles calculated by said processor to a predetermined boundary angle, said predetermined boundary angle being an angle between said two respective, adjacent connecting lines at which a critical bending stress is imposed upon the load rail; and a device configured for at least one of controlling and regulating said adjustment devices in response to a signal from said comparator circuit.

* * * * *